US006060974A

United States Patent [19]

Schroter et al.

[11] Patent Number: 6,060,974

[45] Date of Patent: May 9, 2000

[54] HEADER PLATE FOR A LOW PROFILE SURFACE MOUNT TRANSFORMER

[75] Inventors: Bernhard Schroter, Upton; William Ng, Leominster, both of Mass.

[73] Assignee: Compag Computer Corporation, Houston, Tex.

[21] Appl. No.: 09/162,929

[22] Filed: Sep. 29, 1998

[51] Int. Cl.[7] ..... H01F 27/29

[52] U.S. Cl. ..... 336/192; 439/82

[58] Field of Search ..... 439/82, 36; 336/192

[56] References Cited

U.S. PATENT DOCUMENTS

| | | | |
|---|---|---|---|
| 2,922,932 | 1/1960 | Glowacki et al. | 335/299 |
| 3,185,948 | 5/1965 | Helberg | 336/192 |
| 4,689,023 | 8/1987 | Strong, III et al. | 439/189 |
| 4,745,388 | 5/1988 | Billings et al. | 336/192 |
| 5,175,525 | 12/1992 | Smith | 336/83 |
| 5,179,365 | 1/1993 | Raggi | 336/65 |
| 5,748,064 | 5/1998 | Smeenge et al. | 336/83 |

OTHER PUBLICATIONS

Coreless Printed Circuit Board (PCB) Transformers with Multiple Secondary Windings for Complementary Gate Drive Circuits; S.C. Tang, Ron Hui, Henry Chung; May 1999; IEEE Transactions on Power Electronics.

*Primary Examiner*—Lincoln Donovan
*Assistant Examiner*—Michael C. Zarroli
*Attorney, Agent, or Firm*—Paul N. Katz; Ronald L. Chichester; Frohwitter

[57] ABSTRACT

A transformer is provided that consists of a primary winding, a secondary winding and a magnetic core. The primary winding is wound directly around the magnetic core, thereby removing the need for a bobbin. By removing the need for the bobbin, the transformer has a large window utilization factor, and associated low profile. As a result, the transformer has a high power to form factor ratio. A method for making the transformer includes the steps of joining two halves of the core before winding the primary winding. Because the half-cores are joined prior to the wrapping of the primary winding, the core provides bobbin functionality. In addition, a header plate is provided for coupling a plurality of leads of a transformer to sources on an integrated circuit board, where the transformer consists of a magnetic core, a primary winding and a secondary winding. The header plate engages the magnetic core, providing a termination path for the wire of the secondary winding. In addition, the header plate assists in providing electrical insulation for the core while providing a mechanism for ensuring that electrical safety constraints between the primary winding and the core are satisfied.

3 Claims, 10 Drawing Sheets

HEADER PLATE FOR A LOW PROFILE SURFACE MOUNT TRANSFORMER

FIELD OF THE INVENTION

The present invention relates generally to the field of power supplies and more particularly to a low profile transformer and method for manufacturing the same.

BACKGROUND OF THE INVENTION

As it is known in the art, transformers are typically used for providing current and voltage conversion. A transformer may be used to decrease or "step-down" a voltage or alternatively the transformer may be used to increase, or "step-up" a voltage. One use for transformers is in computer power supply design to step down voltages to levels that may be used by components on an integrated circuit board.

Standard transformers that have been used in integrated circuit design have included a magnetic core, a primary winding, a secondary winding and a bobbin. During manufacture, both windings are wound around the bobbin and then placed in the magnetic core. Once the winding and bobbin combination are placed in the core, the leads of the winding may be passed through the bobbin to terminators on the board. Thus, the bobbin serves a dual purpose; to support the windings and also to provide a pathway for wires out of the transformer to the termination on the circuit board.

However, one problem with the standard transformer design is that it has a relatively large profile with respect to the other components on the circuit board. As technological advances have provided more compact and complex integrated circuitry, there is a need to provide computer products having increased performance in a decreased size. Thus, there is a need to pack circuitry more closely together.

It is therefore desirable to maximize the use of space in a transformer having a very small profile. To obtain maximum performance for the transformer, a goal is to fit as much copper into the interior space of the transformer as possible. This is because the more copper that is provided in the transformer, the thicker the conductor and the lower the associated losses. A window utilization factor provides a measurement of the amount of the transformer that is used to pack copper and consequently gives an indication as to the performance capabilities of the transformer. The window utilization factor is a ratio of the area of copper within the transformer to the window space of the transformer. Ideally, a ratio of 1, indicating that the window is 100% utilized with copper would be desirable.

However, because the standard transformer includes a bobbin, the window utilization factor of the standard transformer is less than 1. In fact, because the bobbins of the transformers are subject to minimum thickness requirements, as the profile of the transformer is reduced, the bobbin utilizes a greater percentage of the window area. As a result, the window utilization factor is further reduced. Thus, it is difficult to provide a high performance low profile standard transformer because the amount of copper that is capable of being placed in the transformer is limited by the amount of space required by the bobbin.

One transformer design that provides high power with a low profile is an integrated magnetics transformer. In integrated magnetics transformers, one or more winding are etched into a multi-layered circuit board while the core enclosing the board may or may not include the other windings. Transformer terminations are provided via through holes on the integrated circuit board. Although the integrated magnetic transformers may be used to provide low profile power conversion, it is often difficult to obtain the desired amount of copper cross-section on the circuit board, therefore making it difficult to obtain the desired power conversion capabilities. In addition, to decrease the size of the circuit board, increasingly complex and expensive technologies must be used, making this solution to the problem of providing a low profile transformer undesirable.

SUMMARY OF THE INVENTION

A header plate is provided for coupling a plurality of leads of a transformer to connections on an integrated circuit board, where the transformer consists of a magnetic core, a primary winding and a secondary winding. The header plate engages the magnetic core, providing a termination path for the wire of the primary winding, secondary winding or both. In addition, the header plate assists in providing electrical insulation for the core while providing a mechanism for ensuring that electrical safety spacing constraints between the primary winding and the core are satisfied.

According to one aspect of the invention, a device for coupling at least one lead of a transformer to a circuit board includes a main body having a front face, a rear face and an aperture extending there through, at least one flange positioned on the rear face, the flange positioned to fixedly attach the device to the transformer, at least one sleeve positioned on the front positioned, with the at least one sleeve for accepting a corresponding at least one pin, and wherein a first end of the at least one pin is for coupling the at least one lead and a second end of the at least one pin is for coupling a board.

BRIEF DESCRIPTION OF THE DRAWINGS

Reference will be made to the attached Figures, where like numerals refer to like elements, and wherein.

DESCRIPTION OF ILLUSTRATIVE EMBODIMENTS

Figure 1:
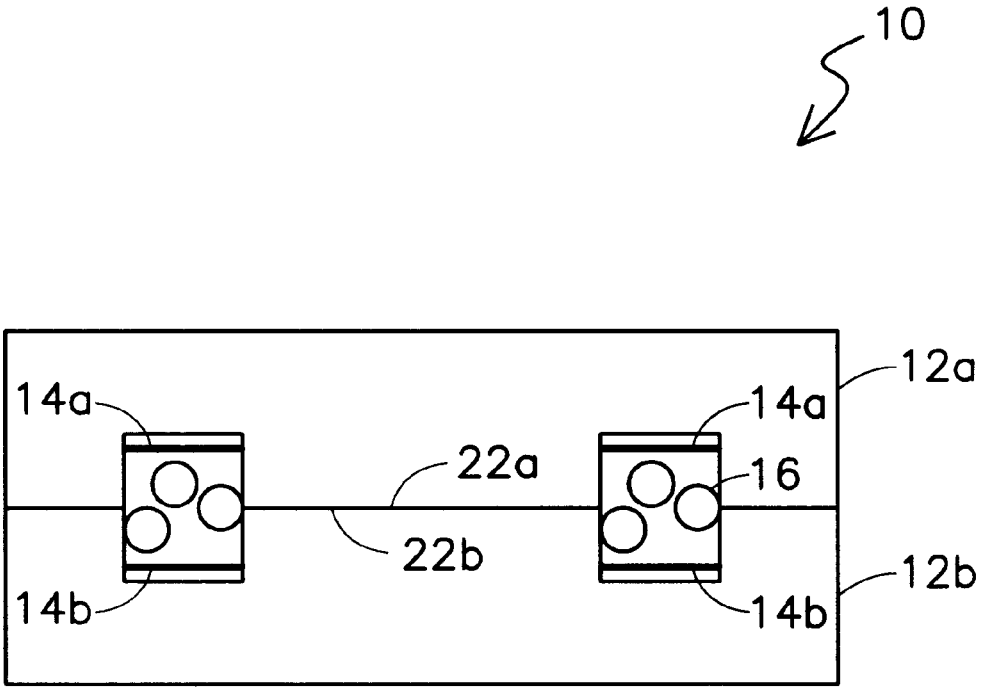
FIG. 1 is a cross section diagram of one embodiment of a transformer in accordance with the present invention.

Referring now to FIG. 1, a cross sectional view of one embodiment of a high-power, low profile transformer 10 is shown to include a magnetic core 12 comprised of two half-cores 12*a* and 12*b*, a primary winding 16 and a secondary winding comprising two secondary winding halves 14*a* and 14*b*. As will be described in more detail below, the magnetic core 12 is used to provide bobbin functionality, thereby providing a low profile, bobbin-less transformer. In this description, the term bobbin-less will be used to describe a transformer that uses no non-conductive material for the purposes of supporting the primary winding.

Throughout the specification, for purposes of clarity the term primary winding will be used to describe the winding 16, which is coupled to the terminations, while the term secondary winding will be used to describe copper disks 14*a* and 14*b*, which couple the transformer to an external circuit. Thus, this specification is describing a step-down transformer. It should be appreciated, however, that the transformer is also capable of performing step-up voltage conversion. When performing step-up voltage conversion, for purposes of terminology the primary winding would designate copper disks 14*a* and 14*b*, while the secondary winding would designate wire 16. Thus, which of the devices is the primary and which is the secondary winding is a function of how the external leads of the transformer are coupled. The present invention is not limited to any particular coupling arrangement of the external leads and thus should not be limited by the references to primary windings and secondary windings below.

Figure 2A:
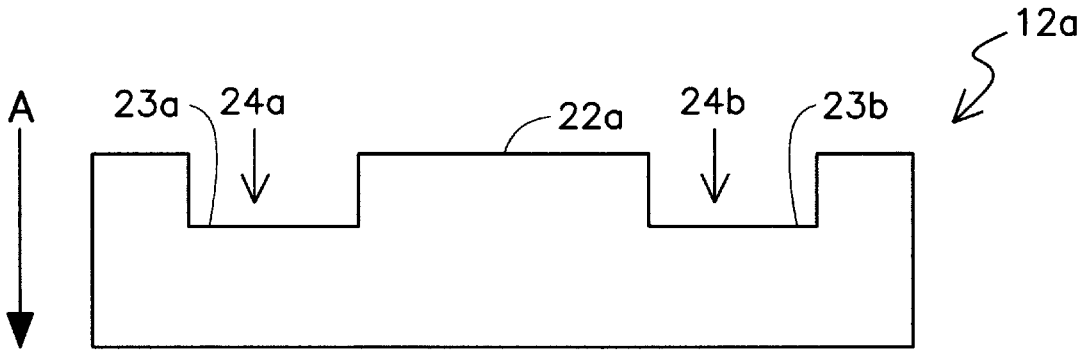
FIGS. 2A and 2B illustrate two views of one embodiment of a half-core that may be used to form the core of the transformer of FIG. 1.
Figure 2B:
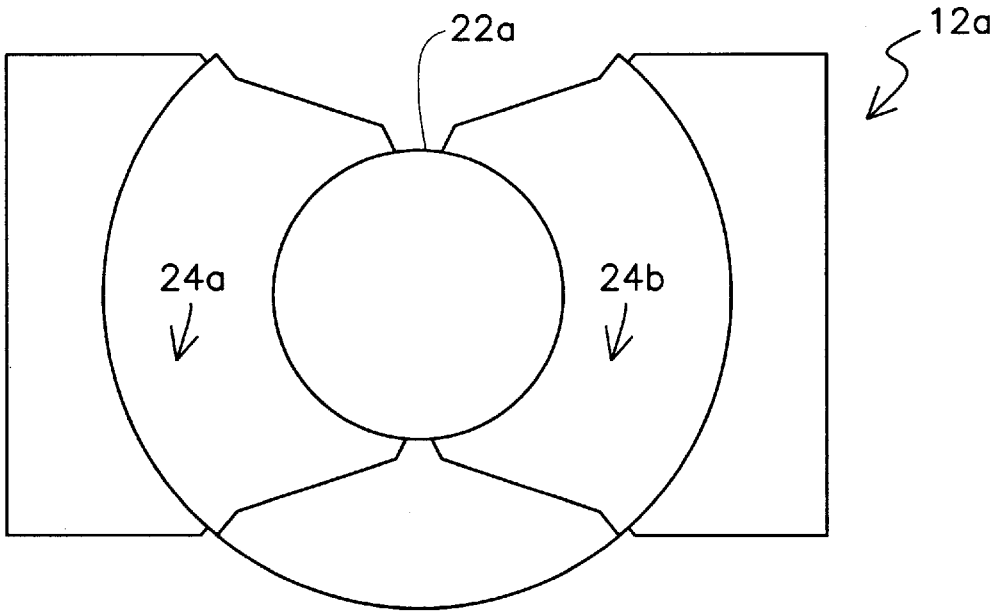

FIGS. 2A and 2B illustrate two views a half-core such as half-core 12*a*. Half-core 12*b* is identical in design to that of 12*a* and will therefore not be described in further detail. The half-core 12*a* is a unitary piece, preferably formed from ferrite. On each side of the half-core is a recess 23*a* and 23*b*. The recesses 23*a* and 23*b* are shaped to surround a secondary winding half when it is inserted in the half-core.

The half-core 12*a* also includes a raised portion 22*a*. The raised portion 22*a* of the half-core 12*a* serves many purposes. One purpose of the raised portion 22*a* is to secure the secondary winding within the half-core. A second purpose of the raised portion 22*a* is to provide a contact point when the two raised portions of the two half-cores are joined. The third purpose of the raised portion 22*a* is to provide a structure around which the primary winding of the transformer may be wound once the two half-cores are connected.

FIG. 2B illustrates a second view of the half-core 12*a*, taken from perspective of the line A in FIG. 2A. The top-down view of the half-core 12*a* illustrated in FIG. 2B illustrates that the recesses 23*a* and 23*b* are circular in shape and that the raised portion 22*a* is also circular in shape. In the illustrated embodiment, a circular shape is used because it corresponds with the shape of the secondary winding half. It should be understood that the present invention is not limited to any particular shape of the secondary winding; an oval or rectangular shape could alternatively be used and corresponding modifications would be made to the shapes of the recesses and raised portions of the half-core.

In FIG. 2B, the top down view of the half-core 12*a* shows that the half-core tapers inward as it approaches the raised portion 22*a*. While tapering the half-core structure as illustrated helps to provide space for manipulating primary winding wire, as will be described in more detail below, it is not a requirement of the invention. A width W defines a width of a window of open space in the transformer when the two half-cores are connected. Points 24*a* and 24*b* are potential epoxy points, on which epoxy may be deposited to secure the secondary winding into the core.

Figure 3A:
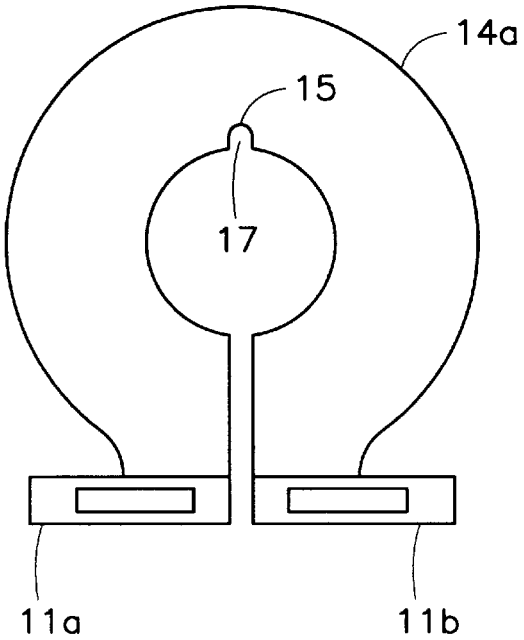
FIG. 3A illustrates one embodiment of a secondary winding that may be used in the transformer of FIG. 1.

FIG. 3A illustrates one embodiment of a secondary winding half 14*a* that may be used in the transformer of the present invention. In one embodiment, the secondary winding half stamped to form a copper disk. The copper disk includes protuberances 11*a* and 11*b* which are used to couple the secondary winding of the transformer to logic on the integrated circuit board. As stated above, although the disk is shown to have a roughly circular shape, it may also be provided as an oval or a square provided that appropriate modifications are made to the corresponding half-core. A preferable shape is one that is maximized to obtain the most copper fill factor in a given area.

A notch 15 is cut into only one of the secondary winding halves 14*a*. The notch 15 provides an access path 17 into the transformer for the primary winding. The notch may be of any particular shape or size and thus the present invention is not limited to any particular shape of the notch 15. To minimize leakages, it is preferable that the access path 17 provided by the notch 15 be closely matched in size to the cross-sectional area of the wire of the primary winding.

Figure 3B:
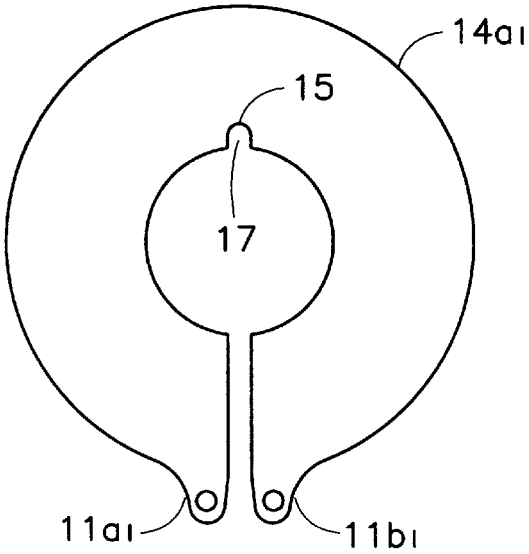
FIG. 3B illustrates a second embodiment of a secondary winding that may be used in the transformer of FIG. 1.

FIG. 3B illustrates a second embodiment of a secondary winding half 14*a*1. The secondary winding half 14*a*1 differs from that of 14*a* due to the shape of the protuberances 11*a*1 and 11*a*2. In one embodiment, the protuberances 11*a*1 and 11*a*2 are asymmetrically centered in the window W of the half-core. As will be described in more detail with regard to FIGS. 4A and 4B, asymmetrically centering the protuberances 11*a*1 and 11*a*2, allows the secondary winding to be coupled to provide either a high power single turn arrangement or in a two turn arrangement.

Figure 3C:
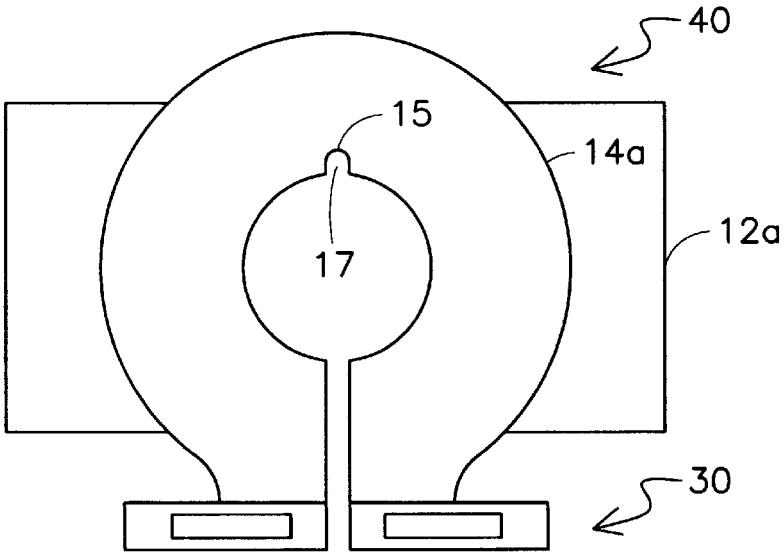
FIG. 3C illustrates the mounting of the secondary winding of FIG. 3A on the half-core of FIG. 2.

FIG. 3C illustrates how the secondary winding half 14*a* is mounted on the half-core 12*a*. Prior to mounting the secondary winding halves on their respective half-cores, each secondary winding half is covered with insulating tape, such as Kapton tape, part number 74-K104-0W70 provided by Furon Corporation of New Haven, Conn. An epoxy is then placed on points 24*a* and 24*b*, and the insulated secondary winding halves 14*a* and 14*b* are inserted into the associated half-core 12*a* and 12*b*, respectively. Suitable epoxies include, but are not limited to, Eccobond 2332-17, Eccobond 50248-F15 and Agomet F300, manufactured by W. R. Grace Corporation.

For purposes of establishing terminology, the front face of the transformer is indicated by arrow 40 and includes that portion of the transformer where the notch 15 is included in the secondary winding half. The rear face of the transformer is indicated by arrow 30 and includes that portion of the transformer where the protuberances 11*a* and 11*b* of the secondary winding half exit the transformer.

Figure 4A:
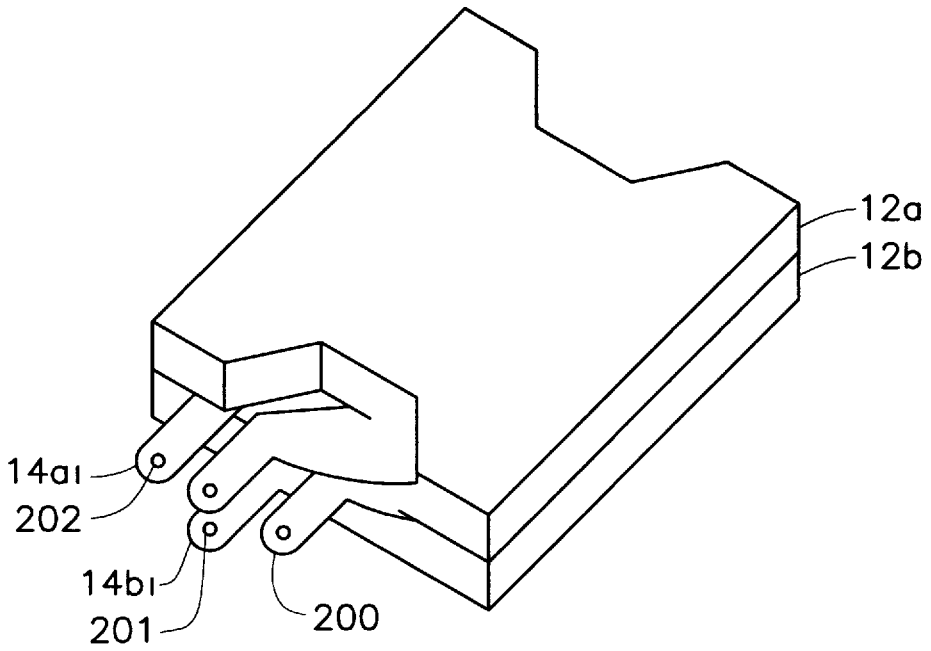
FIG. 4A illustrates one method of coupling the secondary windings of FIG. 3A to provide a two turn secondary winding in the transformer of FIG. 1.
Figure 4B:
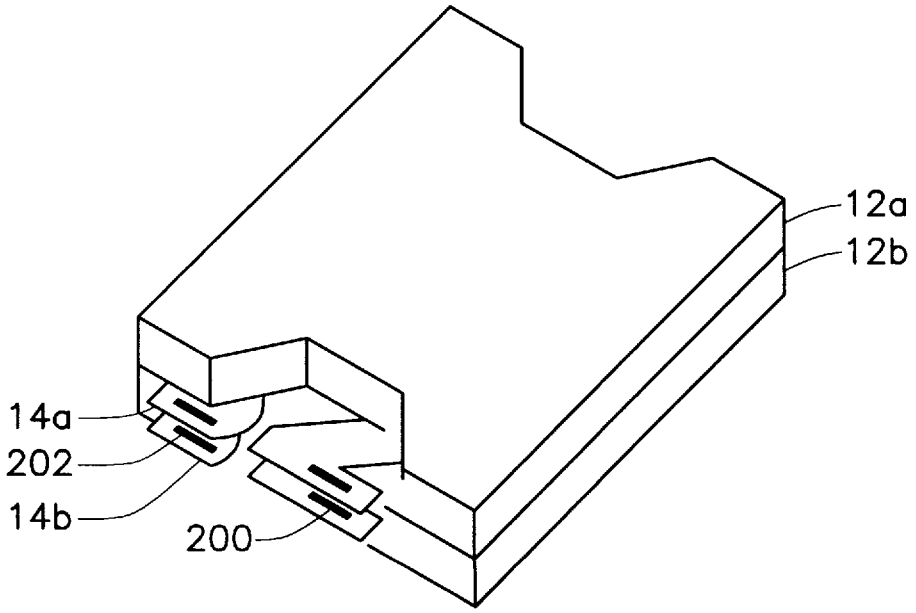
FIG. 4B illustrates a second method of coupling the secondary windings of FIG. 3A to provide a high power single turn secondary winding in the transformer of FIG. 1.

Referring now to FIGS. 4A and 4B, two embodiments of the transformer are shown, each having the secondary windings 14*a* and 14*b* coupled in a different arrangement. In FIG. 4A, the secondary windings 14*a* and 14*b* are coupled to provide two turns, with an input signal being received from connection 200 in secondary winding 14*b*1, winding around 14*b*1 and transferring to secondary winding 14*a*1 by connection 201, winding around secondary winding 14*a*1 and continuing out at connection 202. In FIG. 4B, the secondary winding protuberance 11*a* of both secondary windings 14*a* and 14*b* are both coupled to connection 200, while secondary winding protuberance 11*b* of both windings 14*a*and 14*b* are coupled to connection 202, thereby providing one high powered secondary winding.

Figure 5A:
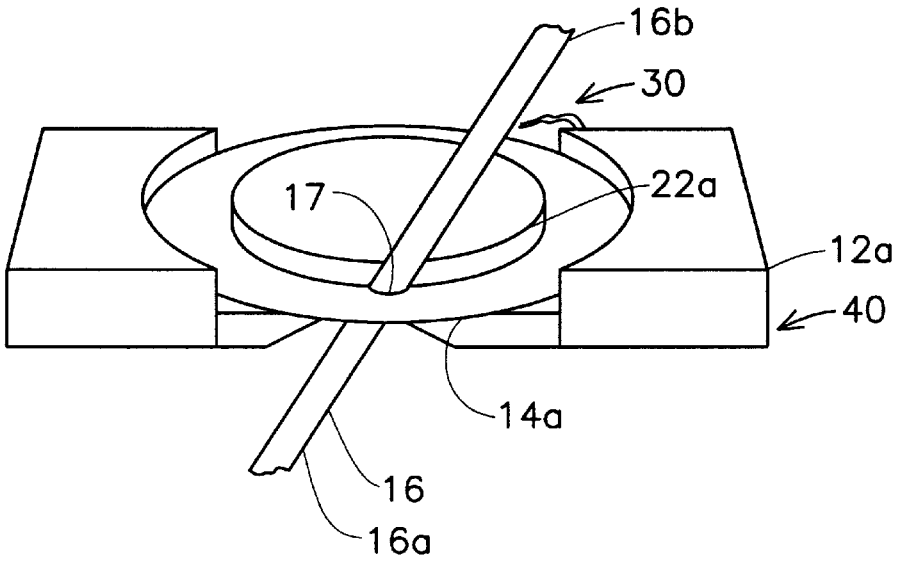
FIG. 5A illustrates one method of feeding a primary winding into the transformer of FIG. 1.
Figure 5B:
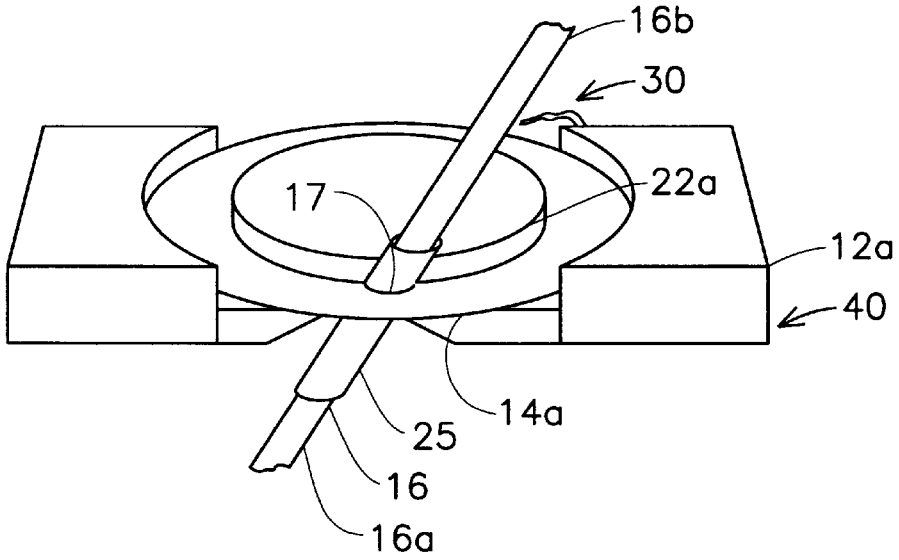
FIG. 5B illustrates a second method of feeding a primary winding into the transformer of FIG. 1 including a protective device.

Referring now to FIGS. 5A and 5B, once the secondary winding halves 14*a* and 14*b* have been coupled to their respective half-cores, the primary winding may be input into the transformer. In one embodiment, the primary winding 16 is formed from wire having a first end 16*a* and a second end 16*b*. The primary winding wire may, for example, be formed from a triple insulated wire such as part number NELC150/44SPPFA-UL, manufactured by New Electric Wire, although suitable substitutes may alternatively be used. In one embodiment, the primary winding wire 16 may be fed directly through the hole 17 of notch 15 of the secondary winding, as illustrated in FIG. 5A. In a second embodiment, illustrated in FIG. 5B, a TEFLON™ (trademark for tetrafluoroethylene fluorocarbon polymers) tube 25 is inserted into the notch 15, and the primary winding wire 16 is next inserted through the tube 25. In this embodiment, the TEFLON™ tube 25 helps to protect the wire from being cut by the secondary winding half 12*a*.

Figure 6:
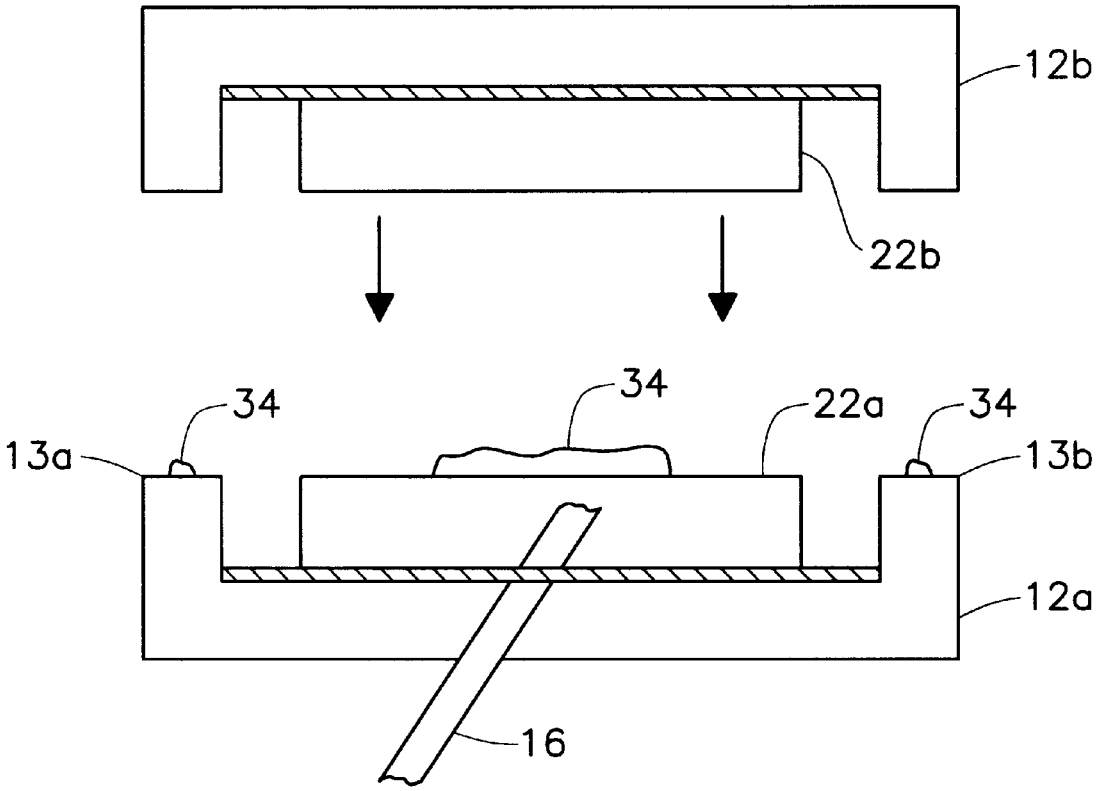
FIG. 6 illustrates the joining of two half-cores, such as those shown in FIGS. 2A and 2B, to form a core of the transformer of FIG. 1.

Referring now to FIG. 6, once the primary winding 16 has been inserted into the transformer half-core 12*a*, the second half-core 12*b* is coupled to the first half-core 12*a*. An epoxy 34 is placed on raised portion 22*a* of the half-core 12*a* (or alternatively raised portion 22*b* of half-core 12*b* or both). Epoxy may also be placed on ferrite half core portions 13*a* and 13*b*. A suitable epoxy may include, but are not limited to, Eccobond 2332-17, Eccobond 50248-F15 and Agomet F300 described above. The two half-cores are pressed together and baked to form a unitary core piece 12. The joined regions 22*a* and 22*b* in the core 12 together form a bobbin-like structure around which the primary winding may be wound.

Thus, the transformer 12 is a bobbin-less transformer. That is, no non-conductive material, whether it be a plastic bobbin or an integrated circuit card, is introduced to the transformer for the purposes of supporting the windings. Rather, the entire transformer consists of only those elements necessary to achieve the magnetic characteristics of the transformer; the primary winding, the secondary winding and the core. With such an arrangement, a high power, low profile transformer having a high window utilization factor provided.

Because the transformer 10 of the present invention is a bobbin-less transformer, there is no additional mechanism in the transformer for forwarding the leads 16*a* and 16*b* of the primary winding to terminators on the integrated circuit board. According to one embodiment of the invention, a header plate 50 is used to provide a pathway for the leads of the primary winding to the termination points. The header plate also serves the purpose of ensuring that electrical spacing constraints between the primary winding and the core are met and additionally helps to secure insulation material around the transformer. The features of the header plate will be described with regard to FIGS. 7A–7B.

Figure 7A:
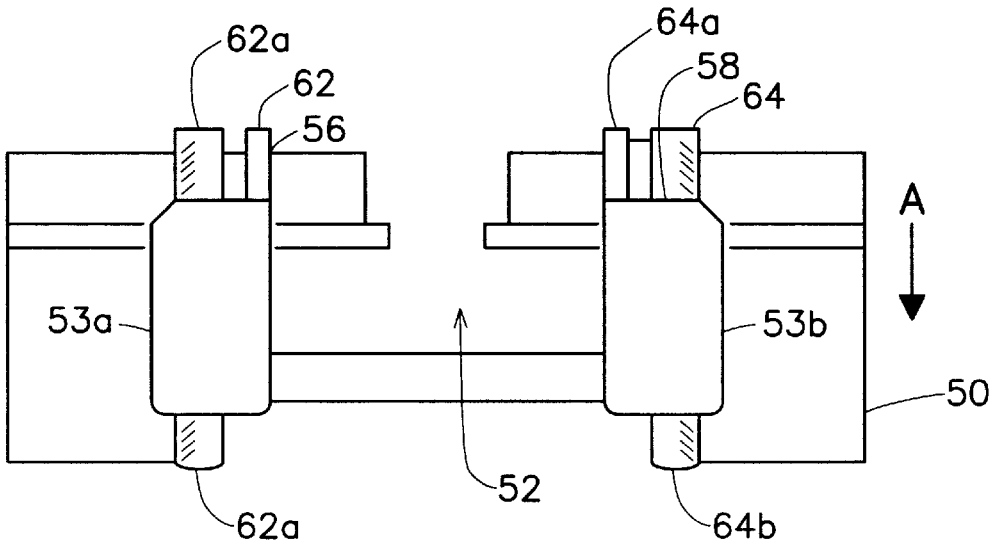
FIGS. 7A and 7B provide two different views of a header plate which may be coupled to the transformer of FIG. 1.
Figure 7B:
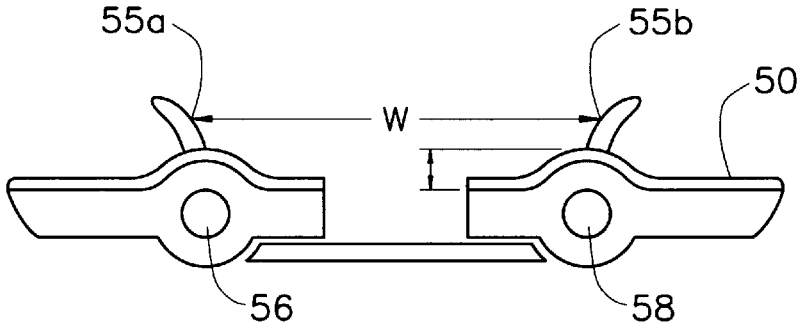

Referring now to FIGS. 7A and 7B, two views are shown of a header plate 50 which may be coupled to the transformer to provide a termination path for the leads 16*a* and 16*b* of the primary winding. The header plate 50 is a unitary piece made of a flexible, inexpensive material such as plastic. The header plate includes two sleeves 56 and 58, through which pins 62 and 64 may be inserted. An aperture 52 is provided in the header plate to accommodate passage of the ends 16*a* and 16*b* of the primary winding.

As shown in FIG. 7B, the header plate additionally includes flanges 55*a* and 55*b*. The flanges 55*a* and 55*b* are spaced a width W apart, where W corresponds to the window width W described in FIG. 2B. The header plate is inserted onto the front face 40 of the transformer 10 by bending the header plate 50 and snapping it into place. The flanges 55*a* and 55*b* grasp the interior wall of the transformer to secure the header plate 50.

Once the header plate is attached to the transformer front face 40, the ends 16*a* and 16*b* of the primary winding may be coupled to the ends 62*a* and 64*a* of pins 62 and 64, respectively. To do this, the electrical insulation is stripped off of the ends 16*a* and 16*b*, and the ends are soldered onto pin ends 62*a* and 64*a*. Thus, the header plate 50 provides a termination path for the primary windings.

The structure of the header plate further fulfills electrical safety constraints mandated by Underwriters Laboratory (UL). For example, UL mandates that a minimum creepage distance must be maintained between any exposed portion of the secondary winding and the core and also between the any exposed portion of the primary winding and the core. A creepage distance is a distance across a surface from one point to another. Features on the header, such as its thickness and detail features such as shelf 59 and the shape of sleeves 53*a* and 53*b* increase the total surface area across which the primary wire must travel between the transformer core and the connection pins 62 and 64. By providing a header having these features, it can be assured that the minimum creepage distance is met, and that electrical safety considerations are satisfied.

For electrical isolation purposes, before the header plate is fastened to the transformer, insulating tape is wound around the body of the transformer, leaving the front and rear portions of the transformer exposed. The ends of the insulation tape extend over the front and rear edges of the transformer, and are folded over prior to affixing the header plate 50. The header plate 50 presses the folded tape against the core, effectively sealing the insulating tape to the core 12. During the reflow process (when the transformer is being soldered to the integrated circuit board), the insulating tape may release if not properly secured. The pressure of the header plate 50 against the insulating tape prevents the insulating tape from becoming unglued during the reflow process. Accordingly, the header plate additionally assists in the insulation of the transformer by securing the insulation tape to prevent it from detaching during reflow.

Figure 8A:
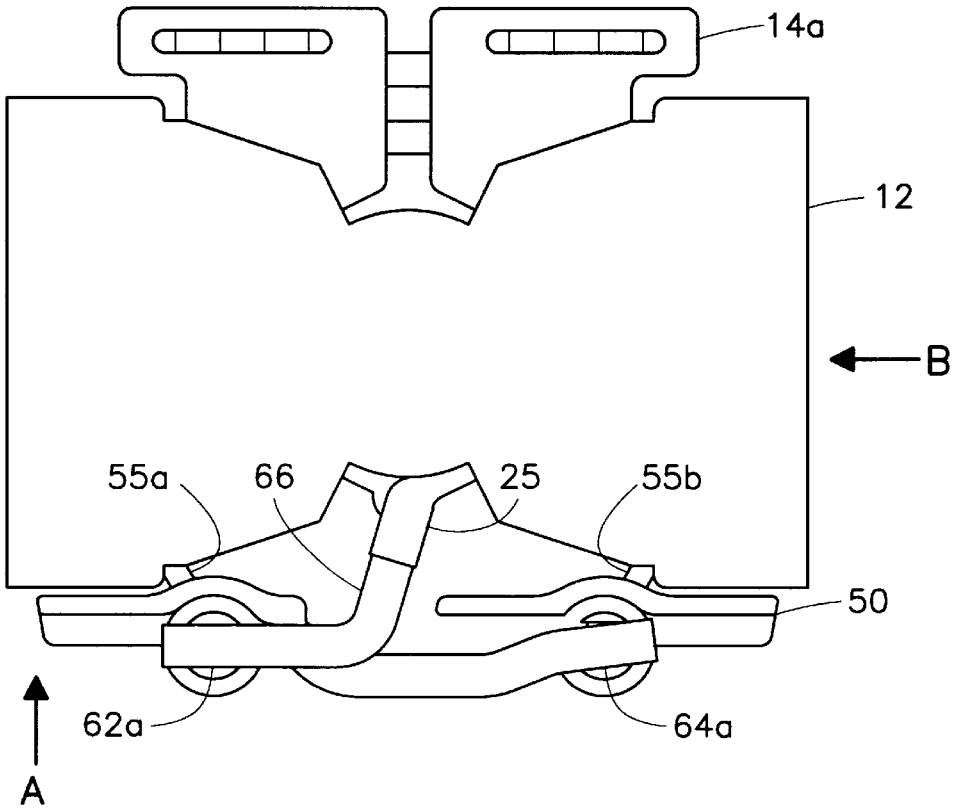
FIGS. 8A through 8C illustrate multiple views of the assembled transformer of FIG. 1 including the header plate illustrated in FIGS. 7A and 7B.
Figure 8B:
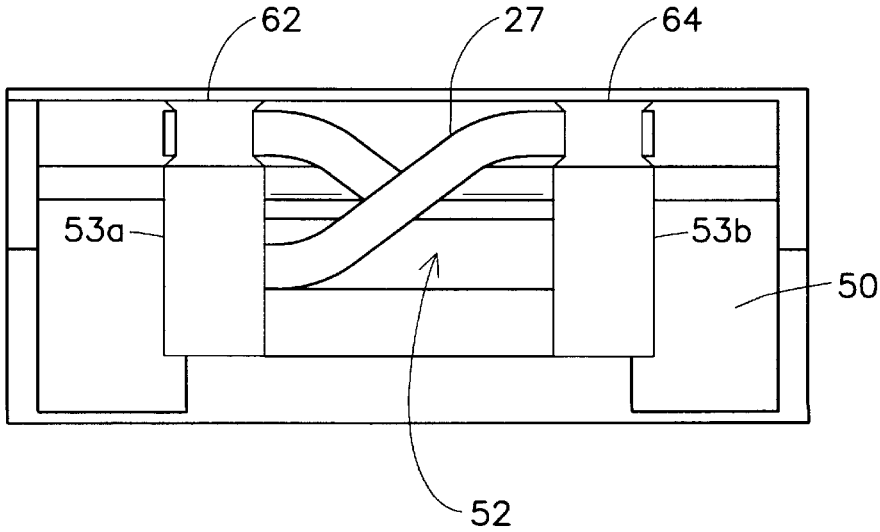
Figure 8C:
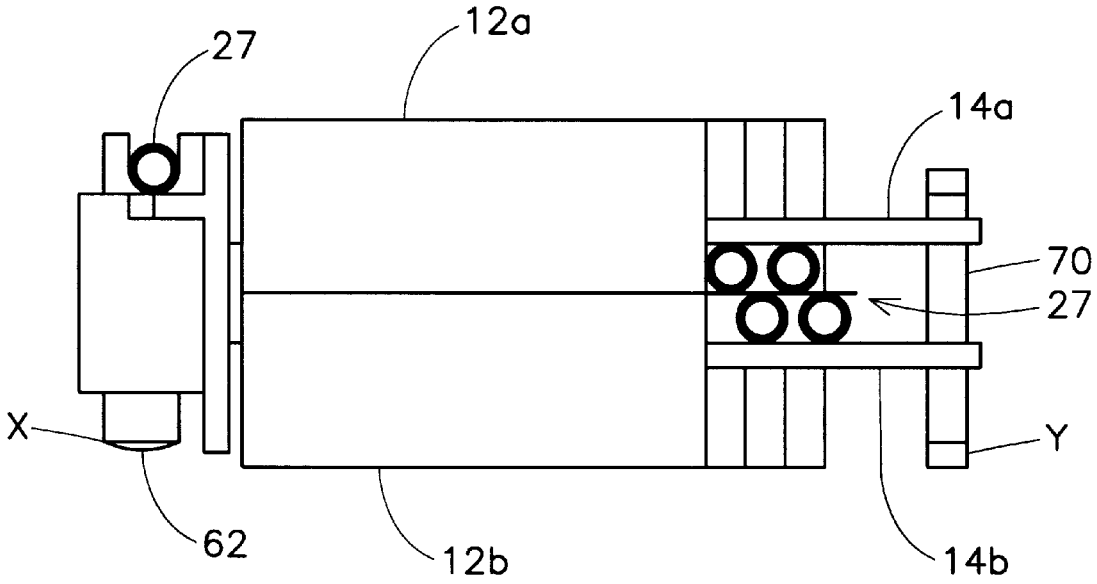

Thus, the header plate provides a termination path for the primary winding, assists in the meeting of electrical safety constraints and additionally assists in the insulation of the transformer. Referring now to FIGS. 8A–8C, a number of views of a fully assembled transformer and header plate pair are shown.

FIG. 8A is a top down view of the transformer 10 and header plate 50 which illustrates how the flanges 55*a* and 55*b* may be used to fixedly attach the header plate 50 to the core 12. FIG. 8B is a front view, taken along the perspective indicated by arrow A of FIG. 8A, for illustrating how the ends of the primary winding 16*a* and 16*b* are soldered to the pins 62 and 64. In FIG. 8C, a side view, taken along the perspective indicated by arrow B in FIG. 8A, illustrates the contact points x and y that will contact the transformer to the integrated circuit board. As shown in FIG. 8C, the primary winding connections (indicated generally as x) are provided on the front of the transformer 10, while the secondary winding connections (indicated generally as y) are provided at the rear of the transformer.

Figure 9:
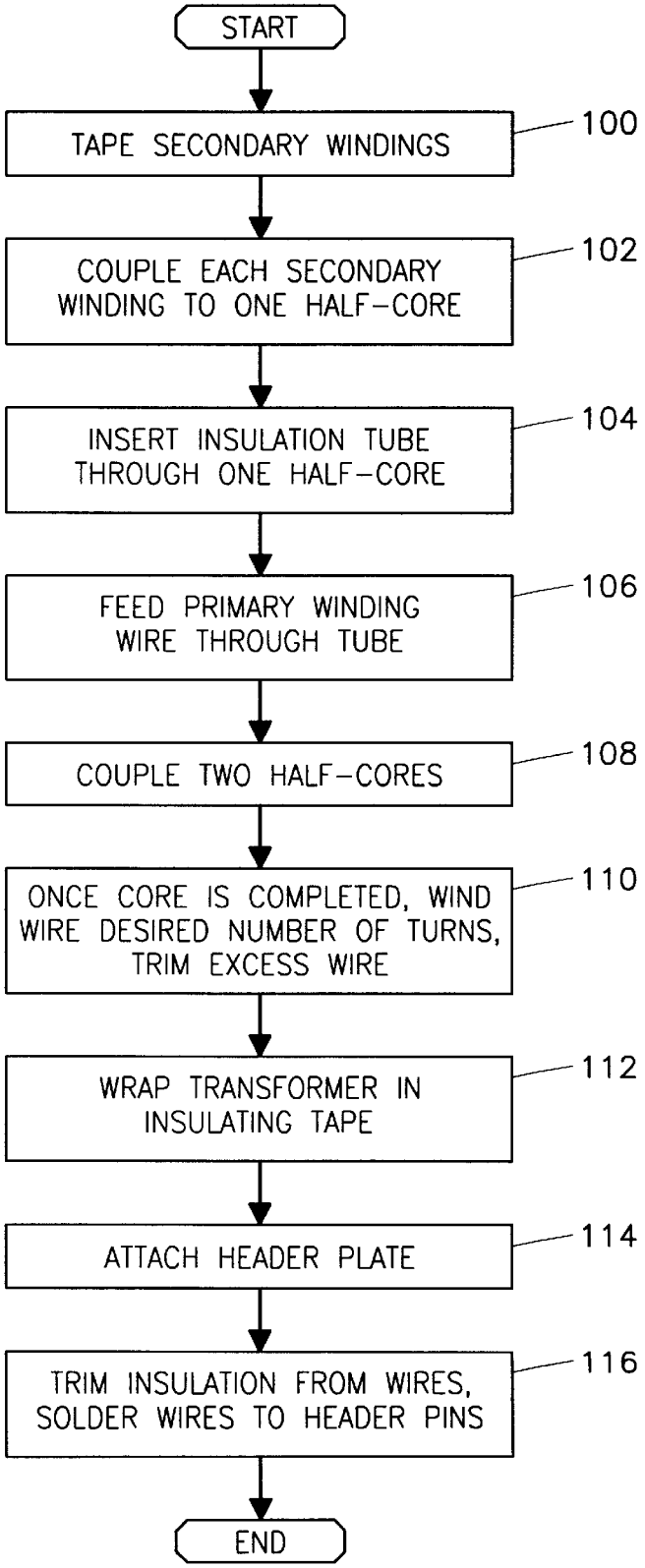
FIG. 9 is a flow diagram illustrating the steps used to provide an assembled transformer and header plate such as that shown in FIGS. 8A–8C.

Referring now to FIG. 9, a flow diagram illustrating a process for assembling the transformer and header pair is shown. The steps have been described discretely above, but are brought together as a process in FIG. 9. At step 100, the secondary windings 14*a* and 14*b* are covered in insulating tape. At step 102, the secondary windings 14*a* and 14*b* are affixed to the half-cores 12*a* and 12*b*, respectively. At step 104, a TEFLON™ tube is inserted into the notch 15 of the secondary winding 12*a*. At step 106, the wire of the primary winding is forwarded through the TEFLON™ tube. At step 108, the two half-cores are then joined, by gluing with epoxy and optionally baking. Once the two half-cores have been joined to form a full core, at step 110 the primary winding wire is wrapped around the core a desired number of turns, and excess wire is trimmed. At step 112, the transformer 10 is wrapped in insulating tape such that the front and rear of the transformer remain largely exposed. Overhanging tape edges are folded over the front and rear portion of the transformer. At step 114 the header plate is attached to the transformer 10. At step 116, insulation is stripped from the leads 16*a* and 16*b* of the primary winding, and the wire ends 16*a* and 16*b* are soldered to the pins 62 and 64. Accordingly, a compact, low profile transformer has been described. In one embodiment, the transformer profile is reduced because the transformer is totally bobbin less; i.e., no non-conductive material that does not perform a power conversion function is used within the transformer body. Because no non-conductive material is used, the a greater window area of the transformer may dedicated to power conversion. For example, in one embodiment of the invention, the dimensions of the transformer are merely 0.360×0.700×0.300 inches, while the transformer is capable of providing 200 W of power, with 48 V received on the primary being converted to the range of 1.5–5 volts. In addition, a header plate, which attaches to the transformer body to provide a pathway for termination leads has also been described. The design of the header plate additionally ensures that electrical constraints are satisfied and also secures insulating material around the transformer.

Having described various embodiments of the invention, it will now become apparent to one of skill in the art that other embodiments incorporating its concepts may be used. It is felt, therefore, that this invention should not be limited to the disclosed embodiment, but rather should be limited only by the spirit and scope of the appended claims.

What is claimed is:

1. A device for coupling at least one lead of a transformer to a circuit board comprising:

a main body having a front face, a rear face and an aperture extending therethrough;

at least one flange positioned on the rear face, the flanged being positioned to fixedly attach the device to a transformer having at least one lead; and at least one sleeve positioned on the front face, the at least one sleeve being arranged for accepting a corresponding at least one pin;

wherein a first end of the at least one pin is for coupling the at least one lead of the transformer and a second end of the at least one pin is for coupling a circuit board; and wherein features of the device are selected such that a distance between the at least one sleeve and the rear face satisfies a predetermined electrical safety constraint.

2. The device according to claim 1 wherein the selected distance is a creepage distance.

3. A device for coupling at least one lead of a transformer to a circuit board comprising:

a main body having a front face, a rear face and an aperture extending there through;

at least one flange positioned on the rear face, the flanged being positioned to fixedly attach the device to a transformer having at least one lead; and at least one sleeve positioned on the front face, the at least one sleeve being arranged for accepting a corresponding at least one pin;

wherein a first end of the at least one pin is for coupling the at least one lead of the transformer and a second end of the at least one pin is for coupling a circuit board;

wherein at least a portion of the transformer is covered with an insulating material, and wherein the device, when coupled to the transformer, secures the insulating material to the transformer.

* * * * *

UNITED STATES PATENT AND TRADEMARK OFFICE

CERTIFICATE OF CORRECTION

PATENT NO. : 6,060,974

DATED : May 9, 2000

INVENTOR(S) : Bernhard Schroter et al.

It is certified that error appears in the above-indentified patent and that said Letters Patent is hereby corrected as shown below:

ON THE TITLE PAGE:

Item [73] please change the Assignee from "Compag" to --Compaq--.

Signed and Sealed this

Sixth Day of March, 2001

Nicholas P. Godici

*Attest:*

NICHOLAS P. GODICI

*Attesting Officer*

*Acting Director of the United States Patent and Trademark Office*